US005509588A

United States Patent [19]

Kimball

[11] Patent Number: 5,509,588

[45] Date of Patent: Apr. 23, 1996

[54] OUTFIT ORGANIZER COVER

[76] Inventor: Cathy S. Kimball, 2055 Tumin Rd., La Habra Heights, Calif. 90631

[21] Appl. No.: 345,123

[22] Filed: Nov. 28, 1994

[51] Int. Cl.[6] ..... A41D 27/22; B65D 85/18

[52] U.S. Cl. ..... 223/98; 206/286

[58] Field of Search ..... 223/98, 85, 87; 206/300, 284, 286, 288

[56] References Cited

U.S. PATENT DOCUMENTS

| | | | |
|---|---|---|---|
| 1,860,024 | 5/1932 | Goldberg | 223/98 |
| 1,982,166 | 11/1934 | Hultquist . | |
| 2,000,324 | 5/1935 | Fleischer | 223/98 |
| 2,085,138 | 6/1937 | Zetlin . | |
| 2,297,860 | 10/1942 | Aranow | 223/98 |
| 2,521,250 | 9/1950 | Pence | 223/98 |
| 2,581,675 | 1/1952 | Lefebure | 223/96 |
| 2,645,195 | 7/1953 | Kleist . | |
| 3,027,056 | 3/1962 | Taff . | |
| 3,110,428 | 11/1963 | Cree . | |
| 3,865,235 | 2/1975 | Levy . | |
| 4,282,911 | 8/1981 | Sumitomo . | |
| 4,620,651 | 11/1986 | Spies . | |
| 4,887,700 | 12/1989 | Rice | 206/284 |

FOREIGN PATENT DOCUMENTS

| | | |
|---|---|---|
| 507490 | 12/1951 | Belgium . |
| 1548320 | 4/1902 | France . |
| 546235 | 2/1932 | Germany . |

*Primary Examiner*—C. D. Crowder
*Assistant Examiner*—Bibhu Mohanty
*Attorney, Agent, or Firm*—Thomas I. Rozsa; Tony D. Chen

[57] ABSTRACT

An outfit organizer cover which can protect the shoulder and neckline of garments from dirt and dust, and to house accessories such as neckties, earrings, necklaces, hosiery, scarves, belts, etc. The outfit organizer cover includes a front layer and a rear layer. The front layer has a loop and strap with a snap fastener and a zipper with opposite tabs for closing pockets of the outfit organizer cover. A small opening at the top of the outfit organizer cover is provided for inserting a conventional hanger therethrough. The rear layer has a zipper with a tab for closing a larger pocket thereon.

20 Claims, 1 Drawing Sheet

OUTFIT ORGANIZER COVER

BACKGROUND OF THE INVENTION

1. Field of the Invention

The present invention relates to the field of garment covers. In particular, the present invention relates to the field of garment covers adaptable to a conventional garment hanger.

2. Description of the Prior Art

Many attempts have been made to provide adequate covers for protecting garments from dust and dirt while they are being stored. However, none of the prior art garment covers include pockets for organizing and storing accessories such as neckties, earrings, necklaces, hosiery, scarves, belts, etc. Consumers traditionally use conventional wire or plastic coat hangers to hang garments, and accessories such as neckties etc. are often draped loosely over the horizontal bar of the hanger. However, not only are such hangers inadequate for keeping dust and dirt off the garments, they are also an inadequate means for retaining accessories on the hangers.

The following twelve (12) prior art patents were uncovered in the pertinent field of the present invention.

1. U.S. Pat. No. 1,982,166 issued to Hultquist on Nov. 27, 1934 for "Service Hanger" (hereafter "the Hultquist Patent").

2. U.S. Pat. No. 2,085,138 issued to Zetlin on Jun. 29, 1937 for "Garment Hanger" (hereafter "the Zetlin Patent").

3. U.S. Pat. No. 2,645,195 issued to Kleist on Jul. 21, 1953 for "Apparel Holder For Coat Hangers" (hereafter "the Kleist Patent").

4. U.S. Pat. No. 3,027,056 issued to Taff on Mar. 27, 1962 for "Garment Hanger Cover" (hereafter "the Taff Patent").

5. U.S. Pat. No. 3,110,428 issued to Cree on Nov. 12, 1963 for "Garment Cover" (hereafter "the Cree Patent").

6. U.S. Pat. No. 3,790,044 issued to Verdile on Feb. 5, 1974 for "Garment Hangers" (hereafter "the Verdile Patent").

7. U.S. Pat. No. 3,865,235 issued to Levy et al. on Feb. 11, 1975 for "Garment-Containing Bags" (hereafter "the Levy Patent").

8. U.S. Pat. No. 4,282,911 issued to Sumitomo on Aug. 11, 1981 for "Combined Hanger And Bag For A Hanger Bag" (hereafter "the Sumitomo Patent").

9. U.S. Pat. No. 4,620,651 issued to Spies on Nov. 4, 1986 for "Clothes Hanger With Concealable Storage Compartment" (hereafter "the Spies Patent").

10. Belgian Patent No. 507,490 (hereafter "the Belgian Patent").

11. French Patent No. 1,548,320 (hereafter "the French Patent").

12. German Patent No. 546,235 (hereafter "the German Patent").

The Kleist Patent discloses an apparel holder for coat hangers. It includes an article holding member formed from a single sheet of cardboard. The upper portion of the sheet is rolled from its edge to form a stiff tube for supporting the remainder of the sheet in a vertical hanging position from the bar of the hanger. The vertical hanging portion of the sheet is provided with a series of horizontal cuts and vertical cuts which form a series of spring tabs and openings. The necktie and belt are inserted through the openings to be hung on the sheet.

The Taff Patent discloses a garment hanger cover. The garment cover is designed to encase completely the body of the hanger using a minimum of paper in the construction of the hanger cover.

The Cree Patent discloses a garment cover. It includes a body member which has a main center panel, a first side panel which is integrally connected to the main center panel along a fold line and a second side panel which is integrally connected to the main center panel along a fold line. A securing tongue is provided to attach the first side panel with the second side panel to complete the garment cover.

The Levy Patent discloses a garment-containing bag. It includes a roll of garment bags disposed on a roller from which a continuous supply of bags are withdrawn.

The Sumitomo Patent discloses a combined hanger and bag. The hanger is constructed of two congruent parallel sections, with a hook which is secured thereto. The bag is provided with reinforcements that are secured between the two parallel frame sections.

The Spies Patent discloses a clothes hanger. The hanger includes a housing extending lengthwise and supported by the ends of the arch portion of the hanger.

The Hultquist Patent discloses a service hanger. It includes a storage receptacle made of a metal container which is connected to a coat hanger by chains.

The Zetlin Patent discloses a garment hanger. It includes a hanger adapted to a cylindrical tubular member.

The Verdile Patent discloses a garment hanger. It includes a compartment for moth crystals, deodorant tables, and the like.

The Belgian Patent, as disclosed from the figures shows a clothes hanger having a bar extending lengthwise under the hanger.

The French Patent, as disclosed from the figures shows a clothes hanger which has a clothes storage compartment formed in the arch portion of the hanger.

The German Patent, as disclosed from the figures shows a clothes hanger with a garment bag suspended from the horizontal bar of the hanger.

None of the prior art patents disclose a garment cover with a multiplicity of pockets for organizing and housing small articles such as neckties, earrings, necklaces, hosiery, scarves, belts, etc., so that the wardrobe will be organized. Therefore, it is highly desirable to design an outfit organizer cover with a multiplicity of pockets which can be used with a conventional hanger and has an effective design and construction for housing small articles.

SUMMARY OF THE INVENTION

The present invention is an outfit organizer cover which can be made in an adult size and a child size. The outfit organizer cover is made of a transparent vinyl material with a multiplicity of pockets. The outfit organizer cover can also be made of opaque material so that advertisements can be placed thereon.

The concept of the present invention outfit organizer cover is to protect the shoulder and neckline of garments from dirt and dust, and to house accessories such as neckties, earrings, necklaces, hosiery, scarves, belts, etc., so that the wardrobe will be organized. A gentleman may choose to organize a necktie, coordinating hosiery, suspenders, handkerchief, etc. The child-size outfit organizer cover can be used to organize matching tights or socks, hair-band or ribbons, belts, gloves, matching panties, etc.

The front layer of the present invention adult size outfit organizer cover includes a loop and strap with a snap fastener means and a zipper with opposite tabs for closing the pockets of the outfit organizer cover. The strap is utilized for holding a scarf, jewelry or the like thereon. A small opening at the top of the outfit organizer cover is provided for inserting a conventional hanger therethrough. The rear layer of the present invention adult size outfit organizer cover includes a zipper with a tab for closing a large pocket thereon.

The child-size outfit organizer cover is similar to the adult size outfit organizer cover with reduced dimensions. The child-size outfit organizer cover does not have the strap holder.

It has been discovered, according to the present invention, that by utilizing an outfit organizer cover with a multiplicity of pockets, it will provide means for organizing and securely housing small articles, such as neckties, earrings, necklaces, hosiery, scarves, belts, etc.

It has additionally been discovered, according to the present invention, that by designing the outfit organizer cover to be short in height, the outfit organizer cover will be able to be stored in lockers and the like. In addition, the outfit organizer cover can fit into standard garment travel bags.

It has further been discovered, according to the present invention, that by designing the outfit organizer cover to be sufficient in length to extend over the garment shoulder, it will be able to protect the shoulder and neckline of garments from dirt and dust.

It is therefore an object of the present invention to provide an outfit organizer cover which is simple in construction, easy to use, substantially non-tearable in normal usage, effective in covering the shoulder and neckline of garments and that is able to organize and securely house within it small articles such as neckties, earrings, necklaces, hosiery, scarves, belts, etc.

It is also an object of the present invention to provide an outfit organizer cover that is short, so that the outfit organizer cover will be able to be stored in lockers and the like.

It is an additional object of the present invention to provide an outfit organizer cover that has a length sufficient enough to cover the shoulder and neckline of garments and protect the garment from dirt and dust.

It is a further object of the present invention to provide an outfit organizer cover which is adaptable to a conventional hanger.

It is an additional object of the present invention to provide an outfit organizer cover which fits into all standard garment travel bags.

In the preferred embodiment, the present invention is an adult size outfit organizer cover which includes two pockets on the front layer with a loop and strap, and an elongated pocket on the back layer.

In an alternative embodiment, the present invention is a child-size outfit organizer cover with reduced dimensions.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Figures 1, 2, 3, 4:
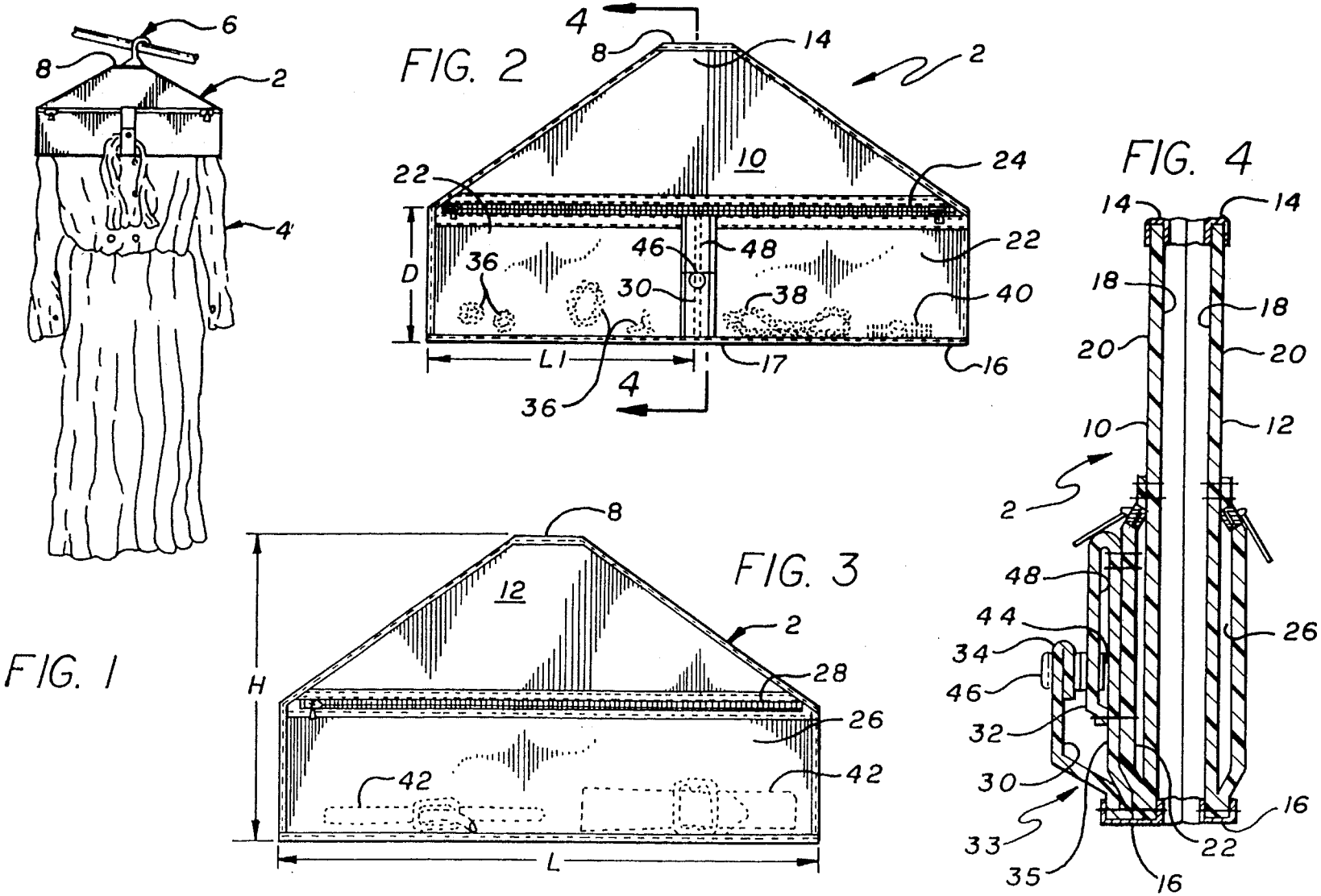
FIG. 1 is a front elevational view of the present invention outfit organizer cover which is covering a garment.
FIG. 2 is an enlarged front elevational view of the present invention outfit organizer cover.
FIG. 3 is an enlarged rear elevational view of the present invention outfit organizer cover.
FIG. 4 is a cross-sectional view taken along line 4—4 of FIG. 2.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 2 an outfit organizer cover for protecting the shoulder and neckline of a garment 4 from dirt and dust, and to house accessories such as neckties, earrings, necklaces, hosiery, scarves, belts, etc., so that the wardrobe will be organized. The outfit organizer cover 2 has a length sufficient enough to cover the upper portion and shoulders of garments such as a suit, dress, etc. or other garments normally disposed in a garment cover and supported from a conventional garment hanger 6 having a triangular shaped body and a shank portion with a supporting hook extending upwardly therefrom and normally received within a small central opening 8.

Referring to FIGS. 1, 2, 3 and 4, the outfit organizer cover 2 is generally a transparent triangular shaped member which has a front layer 10 and a rear layer 12. Each layer includes a top end 14, a bottom end 16, an interior surface 18 and an exterior surface 20. The transparent triangular shaped member has a height which is long enough to cover the shoulder and upper portion of the garment 4. The front layer 10 and the rear layer 12 are attached together on all sides such that the interior surfaces 18 of the front and rear layers 10 and 12 are adjacent to each other, as illustrated in FIG. 4. There is provided at the top ends 14 the small central opening 8 for inserting therethrough the hooked neck of the hanger member 6. The bottom ends 16 form an elongated opening 17 for inserting therethrough the triangular shaped body of the hanger member 6.

Referring to FIG. 2, there is shown a front elevational view of the present invention outfit organizer cover 2 which includes two identical rectangular pockets 22. The two rectangular pockets 22 are attached onto the exterior surface 20 of the front layer 10 on all sides except for a portion opposite the bottom end 16 of the front layer 10 which is left open to form two openings, one for each of the two rectangular pockets 22 respectively.

A first elongated zipper means or closer means 24 is attached to a midsection of the exterior surface 20 of the front layer 10 for closing the two openings of the two rectangular pockets 22. The zipper means 24 has two tab members which are at opposite ends of the outfit cover 2 such that the two tab members are moved toward each other to close the two openings of the two rectangular pockets 22.

The pockets 22 can store many small items; for example earrings 36, a necklace 38 and a watch 40.

Referring to FIG. 3, there is shown a rear elevational view of the outfit organizer cover 2 which includes an elongated rectangular pocket 26. The elongated rectangular pocket 26 is attached onto the exterior surface 20 of the rear layer 12 on all sides except for a portion opposite the bottom end 16 of the rear layer 12 which is left open to form an opening for the elongated rectangular pocket 26. The elongated rectangular pocket 26 has a length equal to the length of the outfit organizer cover 2, and can store longer items, such as belts 42 or neckties.

A second elongated zipper means or closer means 28 is attached to a midsection on the exterior surface 20 of the rear layer 12 for closing the opening of the elongated rectangular pocket 26. The zipper means 28 has only one tab member for closing the opening of the elongated rectangular pocket 26.

Referring again to FIGS. 1, 2 and 4 there is shown an elongated strap 33 which forms a loop 48 and a lower strap 30. The elongated strap 33 has a top end 32 and a bottom end 34. A middle portion 35 of the elongated strap 33 is attached on and between the two pockets 22 such that the top end 32 folds over and down, such that the folded portion is just below the zipper means 24. The middle portion 35 reinforces the two pockets 22 so that the stitching will not tear off. The top end 32 is attached onto a midpoint on the middle portion 35 of the elongated strap 33 and forms the loop 48. The top end 32 is provided with a male or female snap-on type fastener 44 which is attached thereon. The bottom end 34 is folded over and upward, such that the folded portion is just above the bottom end 16 of the front layer 10 and forms the lower strap 30. The tip of the bottom end 34 is folded over once to provide a double backing to reinforce the tip of the bottom end 34 to which a complementary male or female type fastener 46 is attached thereon and faces the fastener 44. The fasteners can be any suitable means capable of retaining the strap 30 to the outfit organizer cover 2. By way of example, the snap-on type fastener 44 can be a male fastener with a hook type surface and the complementary snap-on type fastener 46 can be a complementary female fastener with a loop type surface. It will be appreciated that the fasteners are merely one illustrative embodiment of the present invention. It is also emphasized that while the snap-on type fasteners are preferred, it is also within the spirit and scope of the present invention to have a multiplicity of fasteners. In addition, it will not be too hard for one skilled in the art to interchange the snap-on type fasteners with VELCRO® fasteners or any other suitable fasteners.

All of the edges on the outfit organizer cover 2 are provided with trim bindings to reinforce the outfit organizer cover 2 and may be made of plastic material, vinyl tape or fabric material.

One of the preferred methods of attaching the front and rear layers 10 and 12, and the pockets 22 and 26 of the outfit organizer cover 2 is stitching means. Another method of attaching the front and rear layers 10 and 12, and the pockets 22 and 26 is by a welding process.

The outfit organizer cover 2 may be die-cut from vinyl type fabric and the seams sealed by the welding process. The process of die-cutting is well know in the art, and the description thereof will not be described. It will be appreciated that the outfit organizer cover 2 may be made from many processes and are not limited to the illustrative embodiments of the present invention.

The outfit organizer cover 2 can be made from several materials. By way of example, the outfit organizer cover 2 can be made of polyvinyl chloride (PVC) material. The thickness of the PVC material will be approximately 8 mils (where one mil is one thousandth of an inch). The surfaces of the outfit organizer cover 2 will have a soft hand matte finish to prevent the surfaces from sticking to the garments or to themselves. The PVC material is stronger, does not crease and is not stiff; the PVC material is like fabric. The dimensions of the outfit organizer cover 2 will have two sets of dimensions for the adult and child sizes. By way of example, the length L and height H of the adult-size outfit organizer cover are approximately 23 inches by 13 inches respectively, and the length L1 and depth D of the pockets are approximately 11 inches by 6 inches respectively. By way of example, the length and height of the child-size outfit organizer cover are approximately 14 inches by 9 inches, and the length and depth of the pockets are approximately 7 inches by 4 inches respectively. It will be appreciated that the dimensions described above are merely one illustrative embodiment and can include many other comparable sets of dimensions.

The present invention has many advantageous features including: (a) it is inexpensive to manufacture; (b) the height is short enough to allow it to be stored in a small gym locker; (c) it has pockets for organizing and housing accessories such as neckties, earrings, necklaces, hosiery, scarves, belts, etc; (d) it fits in a standard garment bag for travel; and (e) it fits any conventional hanger.

Defined in detail, the present invention is an outfit organizer cover for a garment having shoulders, and to be used in conjunction with a hanger member having a triangular shaped body and a shank portion forming a hooked neck, comprising: (a) a generally triangular shaped member having a front layer and a rear layer, each layer having a top end, a bottom end, an interior surface and an exterior surface, the triangular shaped member extending substantially downward for partially covering said shoulders of said garment; (b) said front and rear layers being attached together on all sides such that said interior surfaces of said front and rear layers are adjacent to each other, where said top end forms a small central opening for inserting said hooked neck of said shank portion therethrough, and said bottom end forms an elongated opening for inserting said triangular shaped body of said hanger member therethrough; (c) two identical rectangular pockets being attached on said exterior surface of said front layer on all sides except for a portion opposite said bottom end of said front layer which is left open to form two openings one each for the two rectangular pockets respectively; (d) a first elongated zipper means attached to a midsection of said exterior surface of said front layer for closing said two openings of said two rectangular pockets; (e) an elongated pocket being attached on said exterior surface of said rear layer on all sides except for a portion opposite said bottom end of said rear layer which is left open to form an elongated opening for the elongated pocket; (f) a second elongated zipper means attached to a midsection on said exterior surface of said rear layer for closing said elongated opening of said elongated pocket; (g) an elongated strap having a top end, a middle section and a bottom end, the middle section being attached to said exterior surface of said front layer, the top end folded over and down, and the bottom end folded over and upward, the folded top end attached to a midpoint on said middle section and forming a loop, and the folded bottom end forming a lower strap; and (h) a first mating fastener attached onto said top end of said strap and a complementary second mating fastener attached onto a midpoint of said first elongated zipper means and facing said first mating fastener.

Defined broadly, the present invention is an outfit organizer cover used in conjunction with a hanger member and a garment having shoulders, comprising: (a) a triangular shaped member having a front layer and a rear layer, each layer having a top end, a bottom end, an interior surface and an exterior surface, the triangular shaped member extending substantially downwardly for partially covering said shoulders of said garment; (b) said front and rear layers being attached together on all sides such that said interior surfaces of said front and rear layers are adjacent to each other, where said top and bottom ends of said triangular shaped member are left open to form a small opening and an elongated opening respectively; (c) a multiplicity of pockets being attached on said exterior surfaces of said front and rear layers on all sides except for a portion opposite said bottom ends of said front and rear layers which are left open to form a multiplicity of openings for the multiplicity of pockets respectively; and (d) closure means respectively attached to a midsection of said exterior surfaces of said front and rear layers for closing said multiplicity of openings of said multiplicity of pockets.

Defined more broadly, the present invention is an outfit organizer cover used in conjunction with a hanger member and a garment, comprising: (a) a triangular member having a first layer and a second layer, each layer having a top end and a bottom end; (b) said first and second layers being attached together on all sides except for said top and bottom ends of said first and second layers of said triangular member; (c) said bottom ends of said first and second layers being folded upwardly to form at least one pocket on each of said first and second layers respectively, the at least one pocket on each layer being attached to its layer along the pocket's entire circumference except for one side of each pocket which is open to form an opening for the pocket; and (d) means for closing the opening of said at least one pocket on said first and second layers, respectively.

Defined even more broadly, the present invention is a garment cover, comprising: (a) a cover member having a first layer and a second layer, each layer having a narrow top end and a wide bottom end; (b) said first and second layers being attached together on all sides except for said top and bottom ends; (c) at least one pocket attached on said first and at least one pocket attached on said second layer, each pocket having an opening; and (d) means for closing said opening of said each pocket.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An outfit organizer cover for a garment having shoulders, and to be used in conjunction with a hanger member having a triangular shaped body and a shank portion forming a hooked neck, comprising:

a. a generally triangular shaped member having a front layer and a rear layer, each layer having a top end, a bottom end, an interior surface and an exterior surface, the triangular shaped member extending substantially downward for partially covering said shoulders of said garment;

b. said front and rear layers being attached together on all sides such that said interior surfaces of said front and rear layers are adjacent to each other, where said top end forms a small central opening for inserting said hooked neck of said shank portion therethrough, and said bottom end forms an elongated opening for inserting said triangular shaped body of said hanger member therethrough;

c. two identical rectangular pockets being attached on said exterior surface of said front layer on all sides except for a portion opposite said bottom end of said front layer which is left open to form two openings, one each for the two rectangular pockets respectively;

d. a first elongated zipper means attached to a midsection of said exterior surface of said front layer for closing said two openings of said two rectangular pockets;

e. an elongated pocket being attached on said exterior surface of said rear layer on all sides except for a portion opposite said bottom end of said rear layer which is left open to form an elongated opening for the elongated pocket;

f. a second elongated zipper means attached to a midsection on said exterior surface of said rear layer for closing said elongated opening of said elongated pocket;

g. an elongated strap having a top end, a middle section and a bottom end, the middle section being attached to said exterior surface of said front layer, the top end folded over and down, and the bottom end folded over and upward, the folded top end attached to a midpoint on said middle section and forming a loop, and the folded bottom end forming a lower strap; and h. a first mating fastener attached onto said top end of said strap and a complementary second mating fastener attached onto said bottom end of said strap and facing said first mating fastener.

2. The outfit organizer cover as defined in claim 1 wherein said triangular shaped member is made of polyvinyl chloride (PVC).

3. The outfit organizer cover as defined in claim 1 wherein said triangular shaped member is made of transparent material.

4. The outfit organizer cover as defined in claim 1 wherein said triangular shaped member is made of opaque material.

5. The outfit organizer cover as defined in claim 1 wherein said front and rear layers of said triangular shaped member are attached together by stitching means.

6. The outfit organizer cover as defined in claim 1 wherein said first mating fastener is a male fastener with a hook type surface and said complementary second mating fastener is a female fastener with a loop type surface.

7. The outfit organizer cover as defined in claim 1 wherein said first mating fastener is a male snap fastener and said complementary second mating fastener is a female snap fastener.

8. The outfit organizer cover as defined in claim 1 wherein the length of said triangular shaped member is approximately 23 inches and the depth of said pockets are approximately 6 inches.

9. An outfit organizer cover used in conjunction with a hanger member and a garment having shoulders, comprising:

a. a triangular shaped member having a front layer and a rear layer, each layer having a top end, a bottom end, an interior surface and an exterior surface, the triangular shaped member extending substantially downwardly for partially covering said shoulders of said garment;

b. said front and rear layers being attached together on all sides such that said interior surfaces of said front and rear layers are adjacent to each other, where said top and bottom ends of said triangular shaped member are left open to form a small opening and an elongated opening respectively;

c. a multiplicity of pockets being attached on said exterior surfaces of said front and rear layers on all sides except for a portion opposite said bottom ends of said front and rear layers which are left open to form a multiplicity of openings for the multiplicity of pockets respectively;

d. closure means respectively attached to a midsection of said exterior surfaces of said front and rear layers for closing said multiplicity of openings of said multiplicity of pockets; and e. a strap attached to said exterior surface of said front layer and forming a loop thereon, the strap having a top end and a bottom end.

10. The outfit organizer cover as defined in claim 9 further comprising a first mating fastener attached onto said top end of said strap and a complementary second mating fastener attached onto said bottom end of said strap and facing the first mating fastener for securing said loop together.

11. The outfit organizer cover as defined in claim 10 wherein said first mating fastener comprises a male fastener with a hook type surface and said complementary second mating fastener comprises a female fastener with a loop type surface.

12. The outfit organizer cover as defined in claim 10 wherein said first mating fastener comprises a male snap fastener and said complementary second mating fastener comprises a female snap fastener.

13. The outfit organizer cover as defined in claim 9 wherein said front and rear layers of said triangular shaped member are made of vinyl material.

14. The outfit organizer cover as defined in claim 13 wherein said vinyl material has a soft hand matte finish to prevent a garment from sticking to the material.

15. The outfit organizer cover as defined in claim 9 wherein said transparent front and rear layers of said triangular shaped member are made of vinylized fabric.

16. The outfit organizer cover as defined in claim 9 wherein said front and rear layers of said triangular shaped member are attached together by stitching means.

17. The outfit organizer cover as defined in claim 9 wherein said front and rear layers of said triangular shaped member are attached together by a welding process.

18. The outfit organizer cover as defined in claim 9 wherein said front and rear layers are made of transparent material.

19. The outfit organizer cover as defined in claim 9 wherein said front and rear layers are made of opaque material.

20. An outfit organizer cover used in conjunction with a hanger member and a garment, comprising:

a. a triangular member having a first layer and a second layer, each layer having a top end and a bottom end;

b. said first and second layers being attached together on all sides except for said top and bottom ends of said first and second layers of said triangular member;

c. said bottom ends of said first and second layers being folded upwardly to form at least one pocket on each of said first and second layers respectively, the at least one pocket on each layer being attached to its layer along the pocket's entire circumference except for one side of each pocket which is open to form an opening for the pocket;

d. means for closing the opening of said at least one pocket on said first and second layers, respectively; and e. a strap attached to one of said first and second layers and forming a loop thereon.

* * * * *